US005368285A

United States Patent [19]

Kusumoto

[11] Patent Number: 5,368,285

[45] Date of Patent: Nov. 29, 1994

[54] AUTOMATIC SHEET FEEDING APPARATUS

[75] Inventor: Toshihiko Kusumoto, Yokohama, Japan

[73] Assignee: Canon Kabushiki Kaisha, Tokyo, Japan

[21] Appl. No.: 840,557

[22] Filed: Feb. 25, 1992

[30] Foreign Application Priority Data

Feb. 28, 1991 [JP] Japan ..... 3-059610

[51] Int. Cl.[5] ..... B65H 1/28

[52] U.S. Cl. ..... 271/9; 271/110; 271/117; 271/121; 271/164

[58] Field of Search ..... 271/164, 9, 117, 121, 271/125, 124, 110

[56] References Cited

U.S. PATENT DOCUMENTS 4,208,046 6/1980 Shimizu ..... 271/125 X
4,488,829 12/1984 Hidaka ..... 400/605
4,873,547 10/1989 Sasaki et al. ..... 355/316
4,958,823 9/1990 Iwaki ..... 271/164 X
5,052,677 10/1991 Shibata ..... 271/121 X
5,076,562 12/1991 Sai ..... 271/164 X
5,102,112 4/1992 Takahashi ..... 271/164 X

*Primary Examiner*—Richard A. Schacher
*Attorney, Agent, or Firm*—Fitzpatrick, Cella, Harper & Scinto

[57] ABSTRACT

An automatic sheet feeding apparatus has a plurality of sheet supporting means adapted to stack and support sheets and to be arranged laterally side by side below in an image forming device, sheet feeding rollers for feeding out the respective sheets supported by the sheet supporting device, and a guide for supporting the sheet supporting device so that the sheet supporting device can be retracted in a direction intersecting a sheet feeding direction from the sheet feeding device.

22 Claims, 7 Drawing Sheets

AUTOMATIC SHEET FEEDING APPARATUS

BACKGROUND OF THE INVENTION

1. Field of the Invention

The present invention relates to an automatic sheet feeding apparatus used with an image forming system such as a copying machine, printer, printing machine and the like.

2. Related Background Art

Recently, in image recording systems of the above type such as copying machines, the compactness of the systems has been requested to save the installation space. On the other hand, to avoid the troublesome in the sheet supply, it has also been requested to provide a sheet feeding apparatus having the great sheet stack capacity even in the small-sized image forming system.

For these requirements, in the past, as shown in FIG. 7, there has been proposed a sheet feeding apparatus wherein a paper deck b having the great sheet supplying ability is arranged at a side of an image forming system a so that the sheet can be supplied from the paper deck b. However, with this arrangement, since the paper deck b is protruded from the image forming system laterally, the installation space for the system is increased accordingly. Further, since an operator must load new sheets in the paper deck at the side of the system, the working space for the operator must be reserved, thus further increasing the installation space.

By the way, U.S. Pat. No. 4,488,829 discloses a sheet feeding apparatus wherein a pair of trays or cassettes for containing sheets to be fed to a printer are arranged within a frame for supporting the printer. In this apparatus, the pair of trays or cassettes are disposed in an inverted V-shaped fashion so that the sheet is ejected from an outlet formed in an upper central portion of the frame and the sheet is supplied from an inlet formed in a bottom central portion of the printer.

In this way, by arranging a plurality of sheet containing means within the frame for supporting the printer, it is possible to increase the sheet supplying ability.

However, with the arrangement as mentioned above, since the operator must perform the replenishment of the sheets and the loading of the cassettes at the side of the apparatus, the additional working space is required at the side of the apparatus for performing such operation. Accordingly, even when the image forming system can be made small-sized, the installation space therefor cannot substantially be reduced.

SUMMARY OF THE INVENTION

The present invention aims to eliminate the above-mentioned conventional drawback, and an object of the present invention is to provide an automatic sheet feeding apparatus which can increase the sheet supplying ability and reduce the substantial installation space.

According to the present invention, there is provided an automatic sheet feeding apparatus comprising a plurality of sheet supporting means arranged side by side in a horizontal direction within a pedestal on which an image forming system is rested and adapted to stack and support sheets, a plurality of sheet feeding means provided in correspondence to the sheet supporting means and adapted to feed out the sheet supported by the sheet supporting means, and guide means for supporting the sheet supporting means so that each of the sheet supporting means can be retracted in a direction intersecting a sheet feeding direction from the sheet feeding means.

With this arrangement, since the sheets are contained in the sheet supporting means arranged side by side within the pedestal, a great number of sheets can be stacked, and, since the sheet supporting means does not protrude laterally, the installation space can be reduced. Further, when an operator replenishes or loads the sheets in the sheet supporting means, since he can draw the sheet supporting means this side, the replenishment working operation can be simplified and the increase in the working space can be prevented.

Further, the present invention provides an automatic sheet feeding apparatus comprising a plurality of sheet supporting means arranged side by side in a horizontal direction within a pedestal on which an image forming system is rested and adapted to stack and support sheets, a plurality of sheet feeding means provided in correspondence to the sheet supporting means and adapted to feed out the sheet supported by the sheet supporting means, and a guide means for supporting the sheet supporting means that each of the sheet supporting means can be retracted in a direction intersecting a sheet feeding direction from the sheet feeding means, and wherein the sheet feeding means comprises a feed rotary member rotating in the sheet feeding direction and a retard rotary member rotated in a direction opposite to the sheet feeding direction, and the feed rotary member and the retard rotary member are supported by the pedestal via discrete support members arranged at a predetermined distance therebetween.

With this arrangement, since the feed rotary member and the retard rotary members are supported by the pedestal via the discrete support members, if the sheet is jammed between the feed rotary member and the retard rotary member during the sheet feeding effected by the sheet feeding means, after the sheet supporting means is retracted, it is possible to pull the jammed sheet out through the space between the support members without tearing the sheet, thus making the jam treatment easier.

DETAILED DESCRIPTION OF THE PREFERRED EMBODIMENTS

The present invention will now be explained in connection with embodiments thereof with reference to the accompanying drawings.

Figure 1:
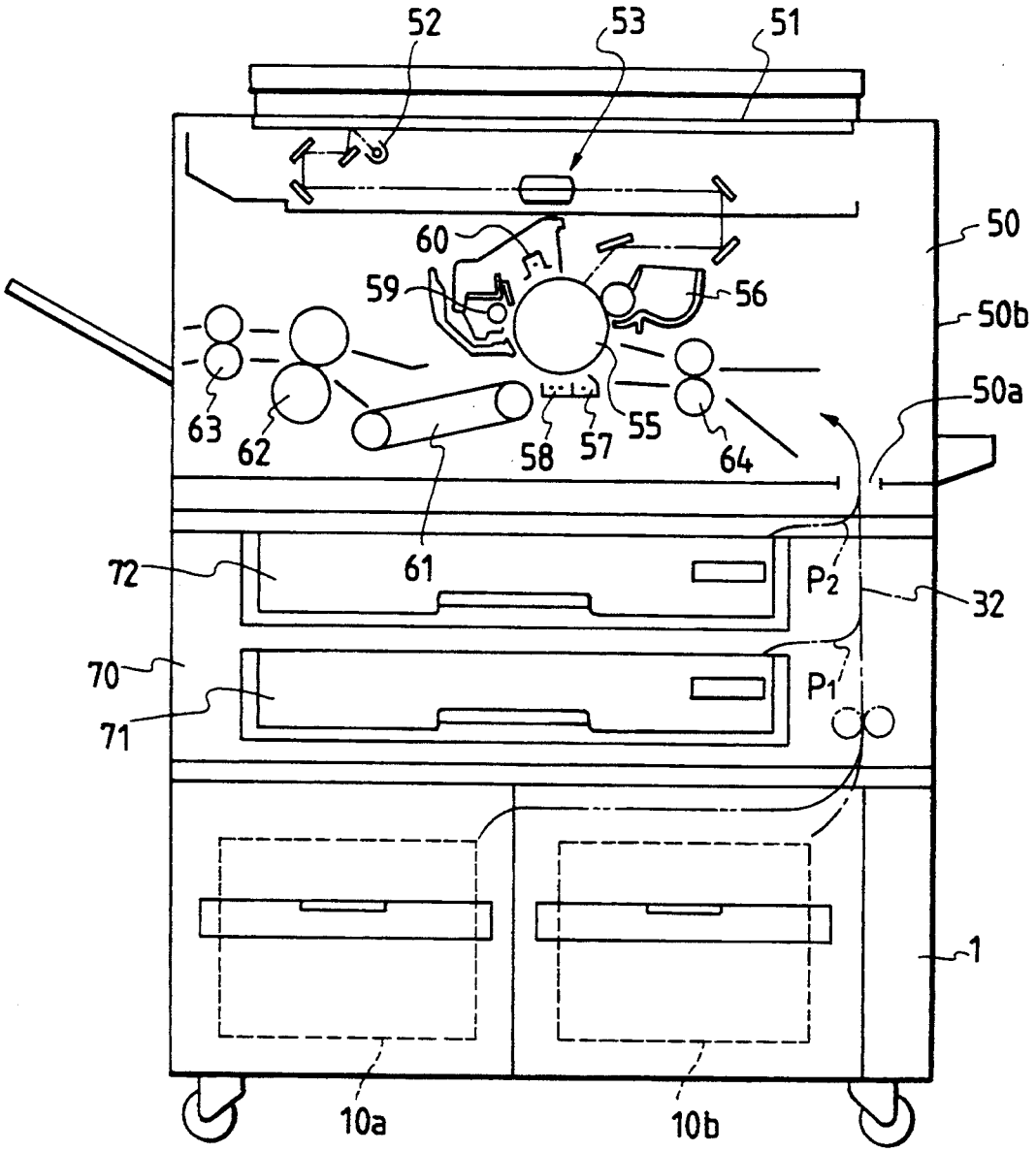
FIG. 1 is an elevational view, partially in section, of an automatic sheet feeding apparatus according to a preferred embodiment of the present invention, with a copying machine.

FIG. 1 shows the whole construction of an automatic sheet feeding apparatus according to a preferred embodiment of the present invention, where a copying machine 50 is mounted on a pedestal 1 and decks (trays) 10*a*, 10*b* acting as sheet supply means providing the great sheet supplying ability are mounted within the pedestal.

Figure 2:
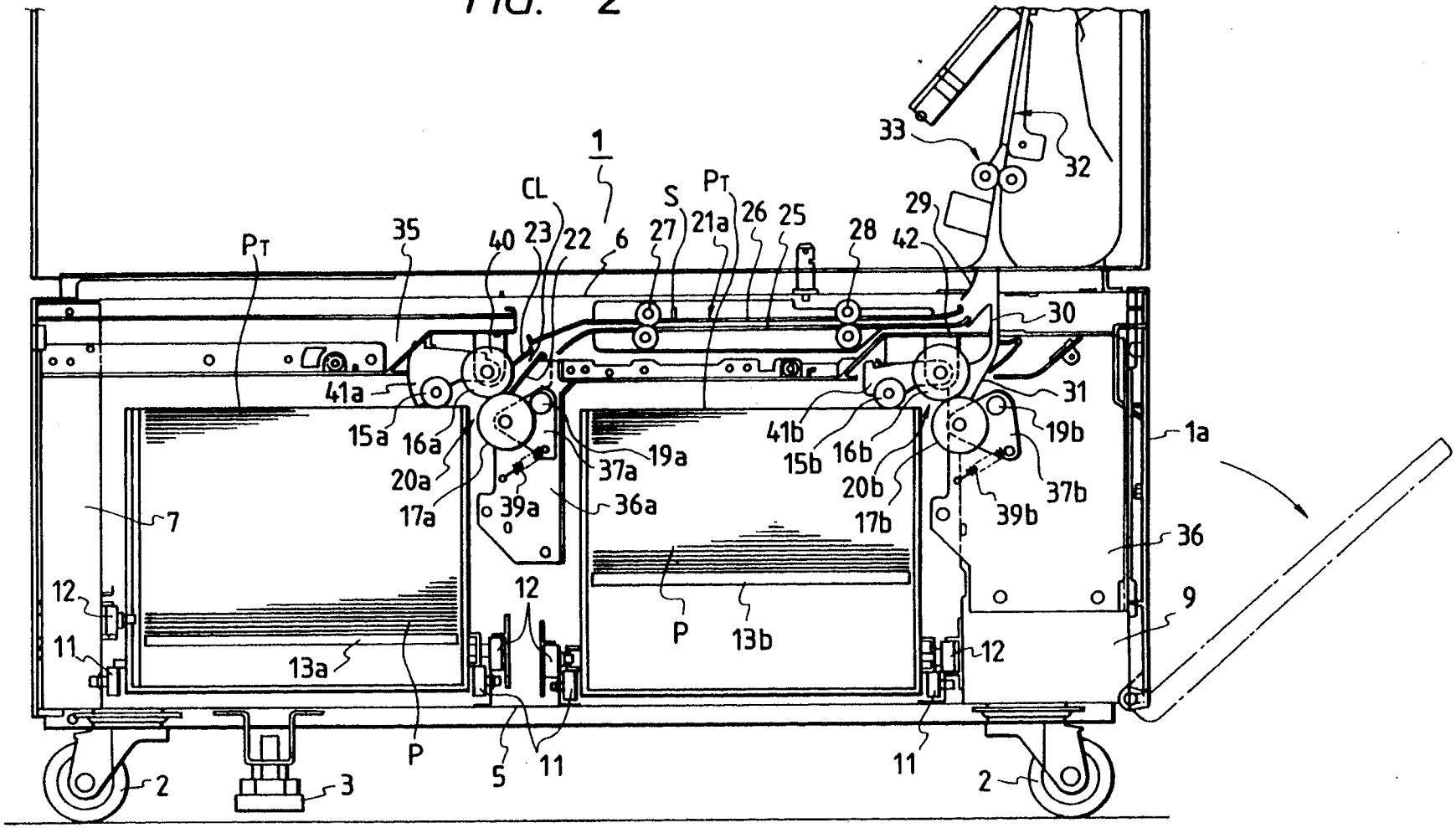
FIG. 2 is a sectional view showing the construction of a sheet supply means disposed with a pedestal of FIG. 1.
Figure 3:
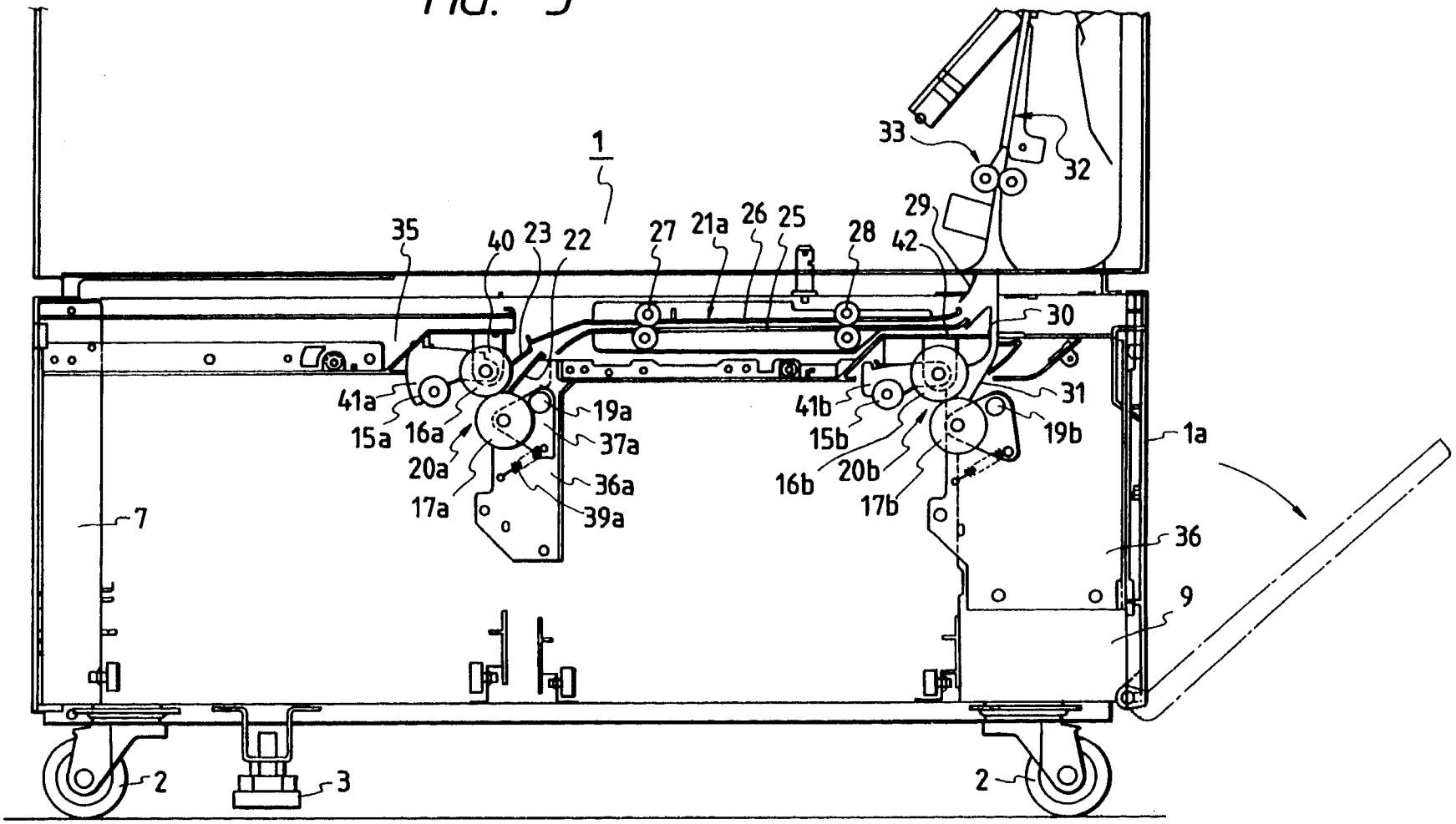
FIG. 3 is a sectional view showing an attachment construction for a sheet feeding means of FIG. 2.

Now, the sheet supply means mounted within the pedestal 1 will be explained with reference to FIGS. 2 and 3. FIG. 2 is a sectional view showing a condition that the decks 10*a*, 10*b* have already been mounted within the pedestal and FIG. 3 is a sectional view showing a condition that the decks 10*a*, 10*b* are removed.

Casters 2 serve to support the pedestal 1 and an adjuster 3 acts as a stopper for fixing the apparatus. A bottom plate 5 and a top plate 6 are interconnected by posts 7 and 9 positioned this side and back side, respectively. An openable door 1*a* is provided at one side of the pedestal 1.

The decks 10*a*, 10*b* can easily be retracted to this side (working side of the copying machine 50) through rollers 11, 12. The decks 10*a*, 10*b* includes intermediate plates 13*a*, 13*b* on which sheets P are stacked and supported, respectively, which intermediate plates 13*a*, 13*b* are lifted or lowered by elevator means (not shown) so that uppermost sheets PT among the sheets P stacked on the intermediate plates are always maintained at a predetermined height.

Next sheet feeding means 20*a*, 20*b* for feeding out the sheets P from the decks 10*a*, 10*b* will be explained.

In FIGS. 2 and 3, the sheet feeding means 20*a* has a pair of front side plates 35 and the sheet feeding means 20*b* has a pair of front side plates 36. The paired front side plates 35 and 36 are arranged in parallel with each other in an front and rear direction (direction perpendicular to a plane of FIG. 2), respectively. Each of the front side plates 36 extends toward the corresponding front side plate 35 so that a gap CL is created between a free end portion 36*a* of the front side plate 36 and the corresponding front side plate 35.

First of all, the sheet feeding means 20*a* will be explained. The pair of front side plates 35 (only one of which is shown) arranged in the front and rear direction have stays 40 secured thereto, respectively, between which a feed roller 16*a* is rotatably supported via a feed roller shaft. Support plates 41*a* pivotally mounted on the feed roller shaft support, at their free ends, a sheet supply roller 15*a* therebetween, which sheet supply roller 15*a* is urged against the uppermost sheet PT with a predetermined pressure by an appropriate means (not shown). Incidentally, the sheet feed roller 16*a* and the sheet supply roller 15*a* are connected to a drive source (not shown) via drive force transmitting means (not shown) so that they are rotated in a sheet feeding direction.

A pivot shaft 19*a* extends between the free end portions 36*a* of the front side plates 36 and rocker plates 37*a* are pivotally mounted on the pivot shaft 19*a*. A retard roller 17*a* is rotatably supported between the rocker plates 37*a* and is urged against the feed roller 16*a* with a predetermined pressure by springs 39*a* connected to the rocker plates 37*a*. The retard roller 17*a* is connected to the drive source (not shown) via a torque limiter (not shown) to be rotated in a direction opposite to the sheet feeding direction.

Next, the sheet feeding means 20*b* will be explained. The pair of front side plates 36 (only one of which is shown) arranged in the front and rear direction have stays 42 secured thereto, respectively, between which a feed roller 16*b* is rotatably supported via a feed roller shaft. Support plates 41*b* pivotally mounted on the feed roller shaft support, at their free ends, a sheet supply roller 15*b* therebetween, which sheet supply roller 15*b* is urged against the uppermost sheet PT with a predetermined pressure by an appropriate means (not shown). Incidentally, the sheet feed roller 16*b* and the sheet supply roller 15*b* are connected to a drive source (not shown) via drive force transmitting means (not shown) so that they are rotated in the sheet feeding direction.

Further, a pivot shaft 19*b* extends between the front side plates 36 and rocker plates 37*b* are pivotally mounted on the pivot shaft 19*b*. A retard roller 17*b* is rotatably supported between the rocker plates 37*b* and is urged against the feed roller 16*b* with a predetermined pressure by springs 39*b* connected to the rocker plates 37*b*. The retard roller 17*b* is connected to the drive source (not shown) via a torque limiter (not shown) to be rotated in a direction opposite to the sheet feeding direction.

Figure 6A:
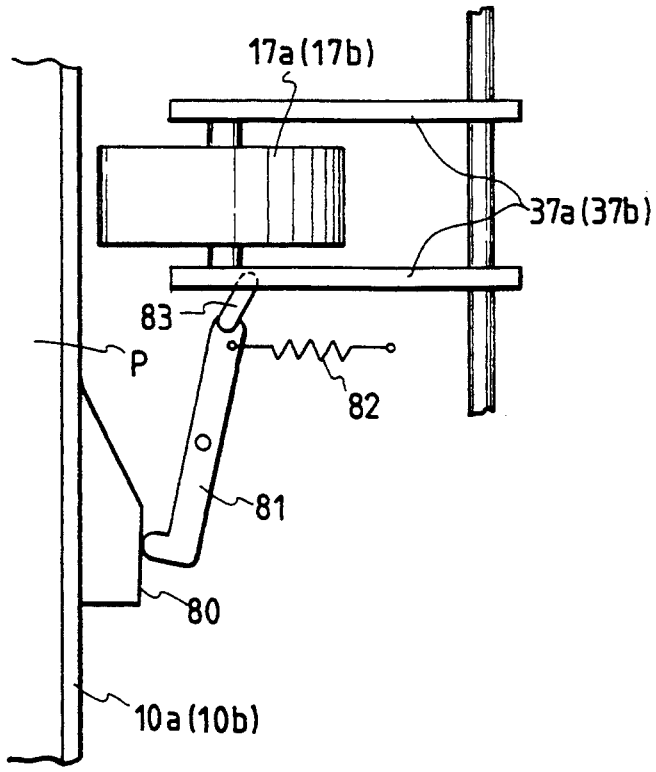
FIG. 6A is a plan view of a means for separating a retard roller from a feed roller and FIG. 6B is a plan view showing the operation of the means of FIG. 6A.

Incidentally, the retard rollers 17*a*, 17*b* of the sheet feeding means 20*a*, 20*b* can be separated from the respective feed rollers 16*a*, 16*b* when the decks 10*a*, 10*b* are retracted or drawn, respectively, by means of a mechanism as shown in FIG. 6A. Such mechanism comprises a cam surface 80 formed on a lateral surface of the deck 10*a* (10*b*), a lever 81 one end of which is contacted with the cam surface 80, a spring 82 for biasing the lever 81 to contact the latter with the cam surface 80, and a link member 83 disposed at the other end of the lever 81. The link member 83 is connected to one of the rocker plates 37*a* (37*b*) supporting the retard roller 17*a* (17*b*).

As shown in FIG. 6A, when the deck 10*a* (10*b*) has been housed within the pedestal 1, the lever 81 is engaged by the high lift portion of the cam surface 80, so that the retard roller 17*a* (17*b*) is urged against the feed roller 16*a* (16*b*) with the predetermined pressure, as shown in FIG. 2.

Figure 6B:
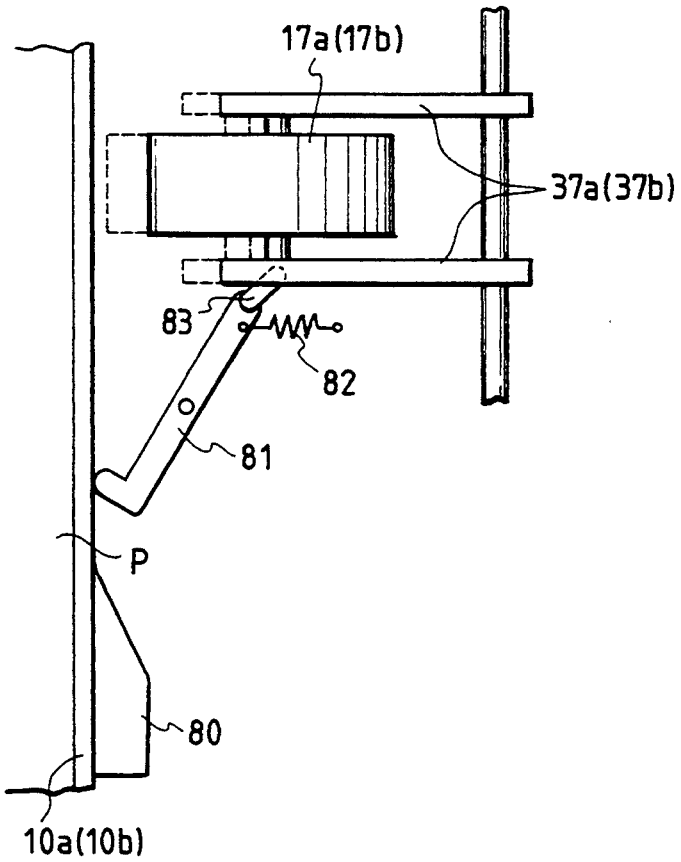
Figure 7:
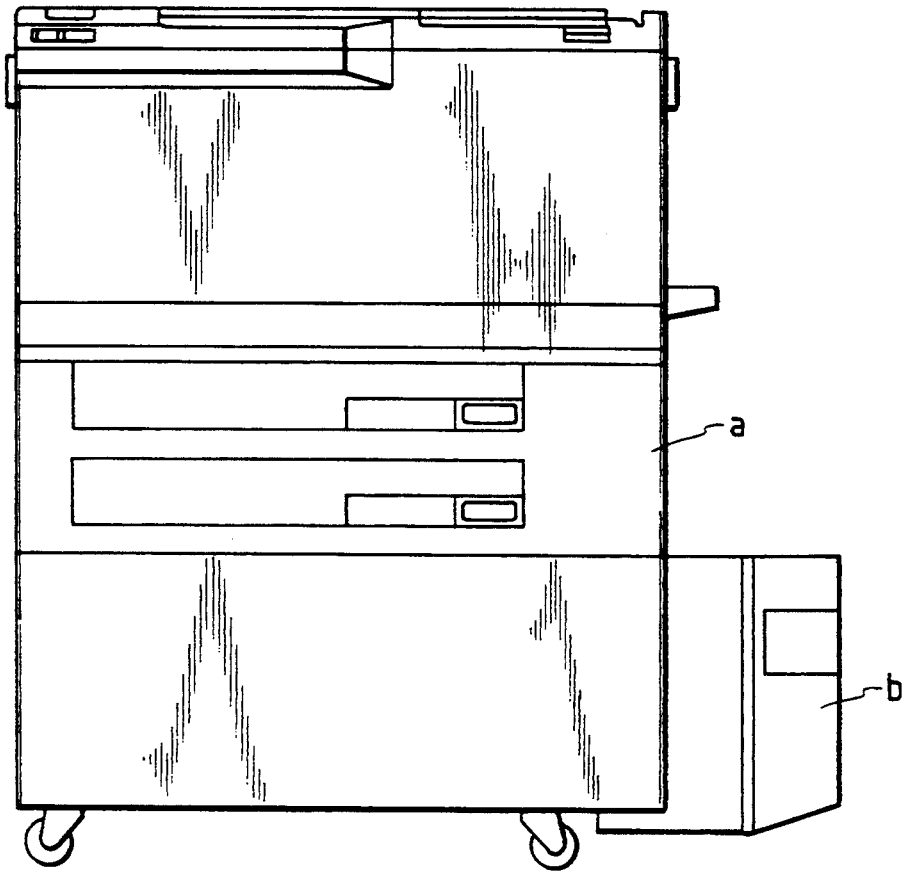
FIG. 7 is an elevational view of a conventional sheet feeding apparatus.

As shown in FIG. 6B, when the deck 10*a* (10*b*) is retracted from the pedestal, the lever 81 is disengaged from the cam surface 80 to rotate in a clockwise direction (FIG. 6B), so that the rocker plates 37*a* (37*b*) are shifted by the link member 83 in opposition to biasing forces of the springs 39*a* (39*b*), thus separating the retard roller 17*a* (17*b*) from the feed roller 16*a* (16*b*).

Now, the relation between the retard roller 17*a* (17*b*) and the corresponding torque limiter will be explained. When two or more sheets P are pinched between the feed roller 16*a* (16*b*) and the retard roller 17*a* (17*b*), since the coefficient of friction between the sheets P is smaller than the coefficients of friction between the sheet P and the feed roller 16*a* (16*b*) and between the sheet P and the retard roller 17*a* (17*b*), the retard roller 17*a* (17*b*) which is fundamentarily rotated in the reverse direction acts to feed the sheet P contacting with this roller in the reverse direction with a friction force slightly greater than a friction force between the sheets P; whereas, the sheet P contacting with the feed roller 16*a* (16*b*) is fed out forwardly by this roller. However, when a single sheet P is pinched between the feed roller 16*a* (16*b*) and the retard roller 17*a* (17*b*), a rotational force generated by the coefficient of friction between the sheet P and the retard roller 17*a* (17*b*) is transmitted to the retard roller 17*a* (17*b*) via the single sheet P. Since the torque limiter is slipped by this rotational force, when the single sheet P is being fed out by the feed roller 16a (16b), the retard roller 17a (17b) is rotated in the normal direction by following the feed roller 16a (16b). In this way, the sheet can be separated without fail.

Next, a sheet conveying portion will be explained.

The sheet P fed from the sheet feeding means 20a is guided by guides 22, 23, guides 25, 26 and guides 29, 30. On the other hand, the sheet P fed from the sheet feeding means 20b is guided by guides 30, 31. The guides 29, 30 and the guides 30, 31 are joined to guide 32 of the copying machine 50 so that the sheet P guided by the guides is fed into the copying machine 50 through the guide 32. A pair of regist rollers 33 are disposed within the guide 32 to control the timing between the feed start of the sheet P and the transfer start of the image at an image forming portion.

The sheet conveying portion 21a comprises the above-mentioned guides 25, 26 and pairs of rollers 27, 28 which are constituted as a single unit. The unit can be retracted in a direction same as the retracting direction of the decks 10a, 10b after the decks have been retracted. Further, the guides 25, 26 can be opened via a hinge (not shown) after the unit 21a has been retracted.

Further, in the vicinity of the pair of rollers 27 of the sheet conveying means 21a, there is provided a sensor (jam detection sensor) S for detecting the stop of the sheet. Other jam detection sensors (not shown) are appropriately arranged in place within various sheet feeding paths and within a sheet feeding path of the image forming portion.

Next, the whole construction of the apparatus and the machine with reference to FIG. 1. Another sheet supply means 70 is provided between the pedestal 1 within which the decks 10a, 10b are housed and the copying machine 50. The sheet supply means 70 comprises a first cassette 71 and a second cassette 72 which can be removably loaded and unloaded from front side (working side of the copying machine).

Sheets P contained in the cassettes 71, 72 are separated and fed one by one by respective sheet feeding means (not shown). The sheet feeding direction for these sheets extends perpendicular to the retracting direction of the cassettes 71, 72. Sheet paths $P_1$, $P_2$ for guiding the sheets from the cassettes 71, 72 are joined to a sheet path (common path) comprising the above-mentioned guide 32. The common path comprising the guide 32 is connected to a sheet insertion opening 50a formed in a bottom of the copying machine 50. Incidentally, the sheet insertion opening 50a is disposed offset toward one of side walls 50b of the copying machine.

Accordingly, the sheets P fed from the decks 10a, 10b and the cassettes 71, 72 are sent to the interior of the copying machine 50 through the guide 32.

Next, the image forming portion of the copying machine will be explained with reference to FIG. 1

The copying machine 50 includes an original support plate 51, a light source 52, and a lens system 53. A copying portion including a cylindrical photosensitive member 55 and the like is arranged at a central portion within the copying machine. Around the photosensitive member 55, there are disposed a developing device 56 containing toner therein, a transfer charger 57, a separating charger 58, a cleaner 59 and a primary charger 60.

At a downstream side of the copying portion, there are arranged a conveying device 61, a fixing device 62 and ejector rollers 63. When a sheet supply signal is emitted form a controller (not shown) of the copying machine 50, the feeding of the sheet from the automatic sheet feeding apparatus is started.

On the other hand, light emitted from the light source 52 and reflected by an original rested on the original support plate 51 is sent to the photosensitive member 55 through the lens system 53. The photosensitive member 55 has previously be charged by the primary charger 60; thus, when light is illuminated on the photosensitive member 55, an electrostatic latent image is formed on the photosensitive member. The electrostatic latent image is then developed by the developing device 56 to form a toner image.

The sheet fed from the cassette 71 or 72 or from the deck 10a or 10b is fed to a pair of regist rollers 64 where the skew-feed of the sheet is corrected. Then, the sheet is sent to the copying portion at the proper timing. At the copying portion, the toner image formed on the photosensitive member 55 is transferred onto the sheet by means of the transfer charger 57. Thereafter, the sheet is separated from the photosensitive member 55 by means of the separating charger 58 which charges the sheet with the charging polarity opposite to that of the transfer charger 57. The separated sheet is then sent, via the conveying device 61, to the fixing device 62, where the non-fused and transferred toner image is permanently fixed to the sheet. Thereafter, the sheet is ejected out of the copying machine by the ejector rollers 63.

In this way, the copying machine can form the image on the sheet fed from the sheet feeding apparatus.

Figure 5:
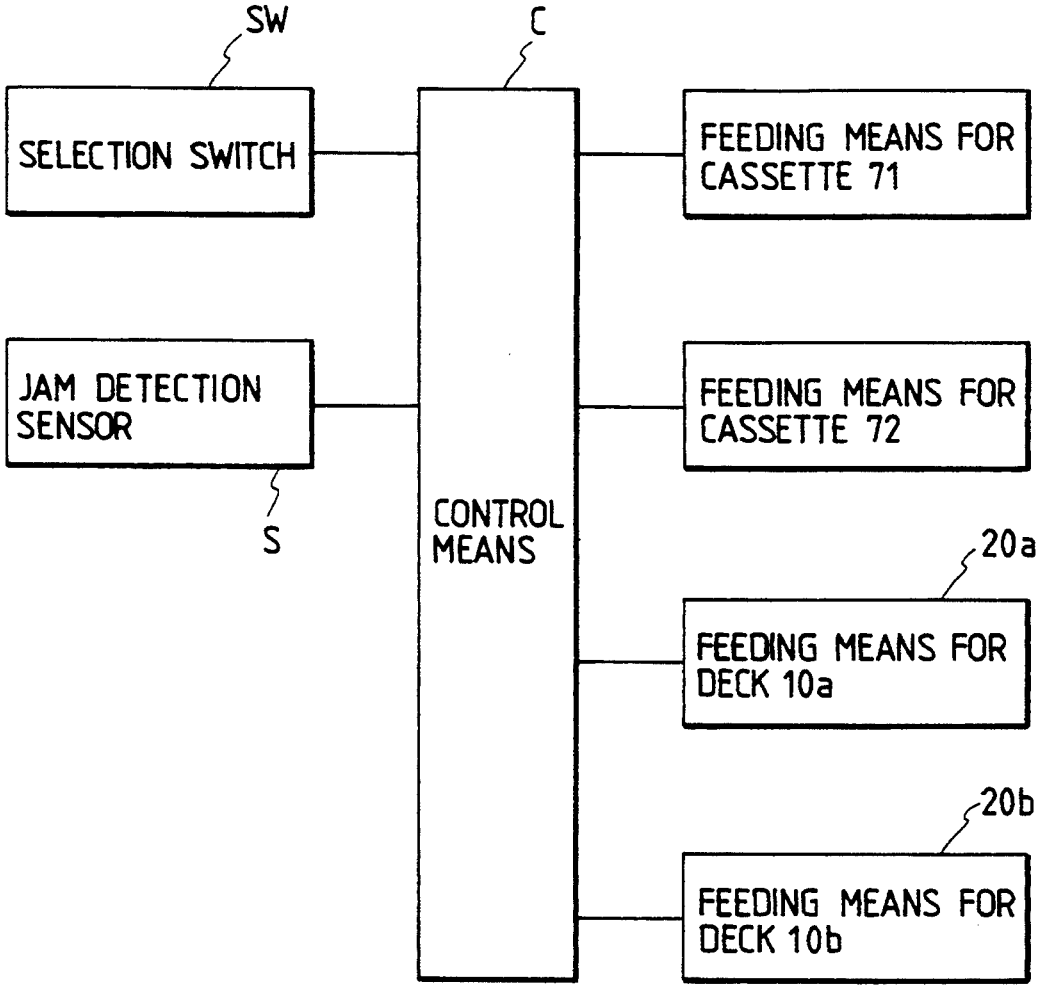
FIG. 5 is a control block diagram of the apparatus of FIG. 1.

FIG. 5 shows a block diagram of a control system for controlling the sheet supplying and feeding operation.

When an operator selects a desired size of the sheet P via a selection switch SW, a control means C sends the sheet supply command to the cassette 71 or 72 or the deck 10a or 10b containing the selected sheets P, with the result that the associated sheet feeding means starts to be driven. Incidentally, if the jamming condition is detected by any jam detection sensor for detecting the sheet jam, the control means C emits a sheet supply stop signal on the basis of the jam detection signal, thus stopping the sheet supplying operation.

The sheet P fed from the deck 10a by the sheet feeding means 20a is conveyed by the conveying portion 21a into the copying machine 50 through the guide 32, and the image is formed on the sheet. Similarly, the sheet P fed from the deck 10b or the cassette 71 or 72 is conveyed through the guide 32 into the copying machine 50, where the image is formed on the sheet.

If the sheet P is jammed during the feeding out of the sheet from the deck 10a (i.e., if the sensor S detects the stop of the sheet P), or if the sheet is jammed in the guide 32 or in the copying machine 50 during the continuous conveying of the sheet P, when the sheet is jammed between the feed roller 16a and the retard roller 17a, the jammed sheet P can easily be removed by retracting the deck 10a, as mentioned above.

Now, the jammed sheet can be removed in two different manners. If a leading end of the jammed sheet is not pinched between the pair of rollers 27 of the conveying portion 21a, when the deck 10a is retracted, since the retard roller 17a is separated from the feed roller 16a in response to the retraction of the deck, the jammed sheet P is retracted through the gap CL between the front side plates 35, 36a together with the deck 10a, thus permitting the easy removal of the jammed sheet. To the contrary, if the leading end of the jammed sheet P is pinched between the pair of rollers 27 of the conveying portion 21a, even when the deck 10a is retracted, the jammed sheet still remains while being pinched by the paired rollers 27. However, by retracting the conveying portion 21*a*, the jammed sheet is also retracted through the gap between the front side plates 35, 36*a*. Then, by opening the guide 26, the sheet P can easily be removed.

Incidentally, if the sheet P fed from the deck 10*b* is jammed on the way, the jammed sheet can be removed opening the side door 1*a* of the pedestal 1. Further, the sheet feeding means 20*b* may be constructed as same as the sheet feeding means 20*a* so that the jammed sheet P can be retracted by retracting the deck 10*b*.

Figure 4:
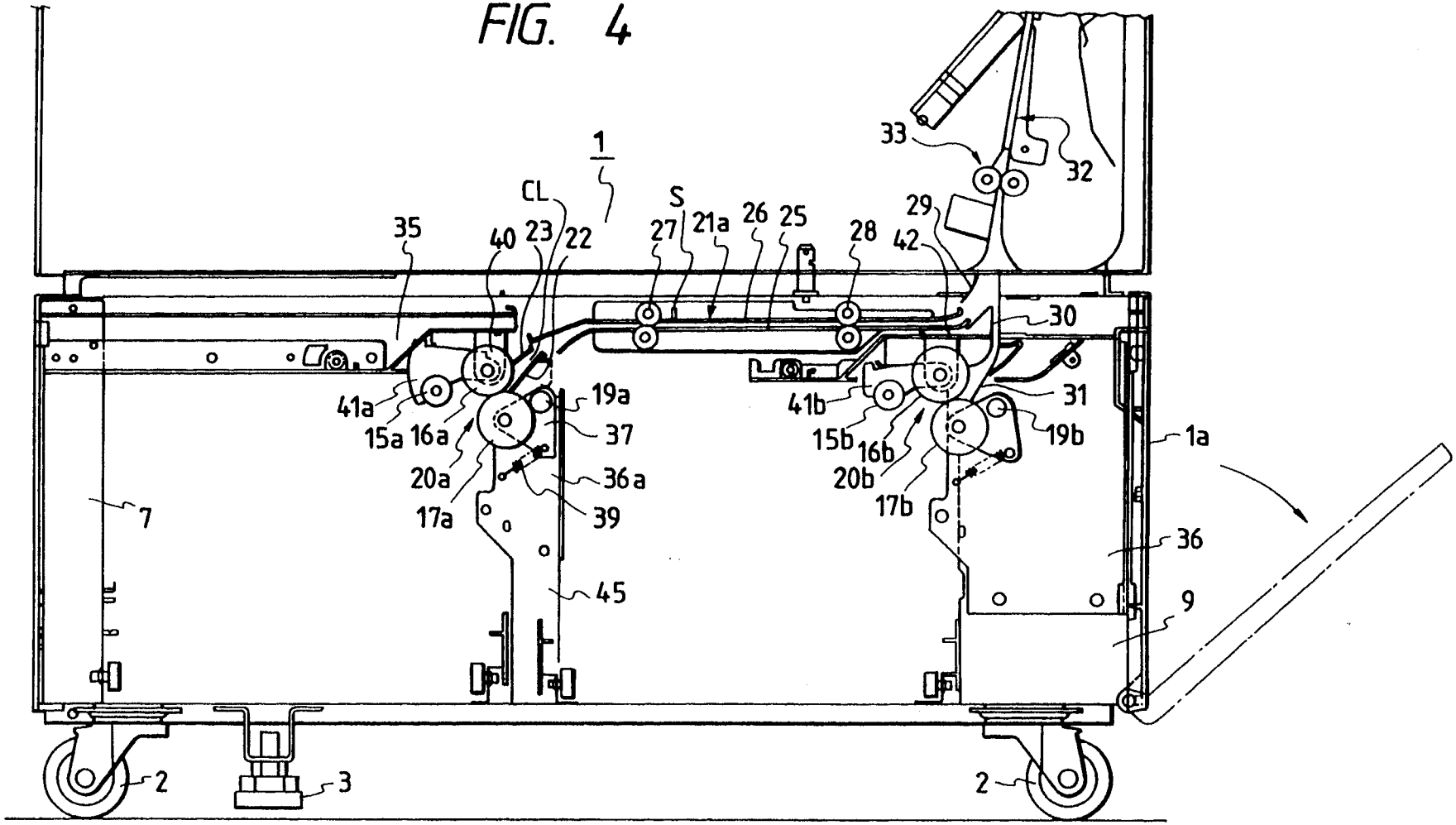
FIG. 4 is a sectional view showing another embodiment of the attachment construction of FIG. 3.

Next, another embodiment will be explained with reference to FIG. 4.

In this embodiment, instead that the front side plates 36 are extended and the retard roller 17*a* is mounted on the free end portions of these plates, non-extended short front side plates 43 are used to support the sheet feeding means 20*b*, and the retard roller 17*a* is rotatably mounted on upper parts of struts 45 secured to the bottom plate 5. Incidentally, the other construction of this embodiment is the same as that of the previous embodiment.

With this arrangement, since the short front side plates 43 are used in place of the extended front side plates 36, the manufacture and attachment of the front side plates are simplified. Incidentally, the other technical advantages obtained by this embodiment are substantially the same as those of the previous embodiment.

While the present invention was explained in connection with special embodiments thereof, it should be noted that the present invention is not limited to such embodiments. For example, the decks may be arranged side by side not within the pedestal but within a frame integral formed with the copyling machine. Further, when the copying machine is large-sized, three or more decks may be arranged side by side. In addition, in separating the sheets, in place of the retard roller, separating pawls or friction pads may be used.

What is claimed is:

1. An automatic sheet feeding apparatus disposed below an image forming apparatus forming an image on a sheet, comprising:

sheet supporting means with a first sheet supporting member and a second sheet supporting member arranged laterally side by side below said image forming apparatus for supporting sheets therein;

first sheet feeding means for feeding out the sheets from said first sheet supporting member to the image forming apparatus;

second sheet feeding means for feeding out the sheets from said second sheet supporting member to said image forming apparatus; and guide means for guiding said first and second sheet supporting members so that said sheet supporting members can be drawn out independently from a sheet feeding position in a direction substantially orthogonal to the lateral arrangement of said first and second sheet support members;

wherein said first and second feeding means are disposed so that they feed out the sheets from said first or second sheet supporting member in the same direction.

2. An automatic sheet feeding apparatus according to claim 1, wherein each of said sheet supporting members is retracted toward an operating side of said image forming apparatus.

3. An automatic sheet feeding apparatus according to claim 1, wherein each of said sheet supporting members comprises a tray capable of supporting a great number of sheet and of lifting and lowering.

4. An automatic sheet feeding apparatus according to claim 1, wherein said sheet supporting means are arranged within a pedestal on which said image forming means is rested.

5. An automatic sheet feeding apparatus according to claim 1, wherein said first and second paths are joined to each other.

6. An automatic sheet feeding apparatus according to claim 5, wherein a common path disposed at a downstream side of a junction between said first and second paths is connected to a bottom inlet opening formed in said image forming apparatus and disposed offset toward one of lateral walls of said image forming apparatus.

7. An automatic sheet feeding apparatus connected to an image forming image on a sheet, comprising:

a plurality of sheet supporting means arranged laterally side by side for supporting respective sheets therein;

sheet feeding means for feeding out the respective sheets from each of said plural sheet supporting means; and guide means for guiding said plural sheet supporting means so that said sheet supporting means can be drawn out independently in a direction substantially orthogonal to a direction in which said plural sheet supporting means are arranged upon supplementing the sheets to said sheet supporting means, wherein said sheet feeding means comprises a feed rotary member rotated in the sheet feeding direction, and a friction separating member for separating the sheets one by one between said friction separating member and said feed rotary member, said feed rotary member and said friction separating member being supported by discrete support members, said support members arranged with a predetermined gap therebetween.

8. An automatic sheet feeding apparatus according to claim 7, wherein each of said sheet supporting means is drawn out toward an operating side of said image forming apparatus.

9. An automatic sheet feeding apparatus according to claim 7, wherein said sheet feeding means include detection means for detecting the fact that the sheet is stopped while being pinched between said feed rotary member and said friction separating member.

10. An automatic sheet feeding apparatus according to claim 7, wherein said friction separating member comprises a retard roller rotated in a direction opposite to a rotating direction of said feed rotary member.

11. An automatic sheet feeding apparatus according to claim 10, further including a release means for releasing a sheet separating pressure between said feed rotary member and said retard roller in response to a drawing out movement of said sheet supporting means.

12. An automatic sheet feeding apparatus connected to an image forming apparatus forming an image on a sheet, comprising:

a first sheet supporting means arranged below the image forming apparatus for supporting sheets therein;

a second sheet supporting means arranged below the image forming apparatus side by side relative to said first sheet supporting means for supporting sheets therein;

sheet feeding means provided in correspondence to said first and second sheet supporting means for feeding out the sheets from said first and second sheet supporting means;

guide means for guiding said first and second sheet supporting means so that they can be drawn out independently in a direction substantially orthogonal to a direction said first sheet supporting means and said second sheet supporting means are arranged;

a first path for introducing the sheet fed from said first sheet supporting means to said image forming apparatus; and a second path disposed above said first sheet supporting means for introducing the sheet fed from said second sheet supporting means to said image forming apparatus, wherein said second path is drawn out in the same direction as a drawing direction of said first sheet supporting means.

13. An automatic sheet feeding apparatus according to claim 12, wherein said sheet supporting means are arranged within a pedestal on which said image forming apparatus rests.

14. An automatic sheet feeding apparatus according to claim 12, wherein said first and second paths are joined to each other on the way.

15. An image forming system, comprising:

an image forming apparatus for forming an image on a sheet;

sheet supporting means comprising a first sheet supporting member and a second sheet supporting member arranged laterally side by side below an image forming apparatus for supporting sheets therein;

first sheet feeding means for feeding out the sheets from said first sheet supporting member to the image forming apparatus;

second sheet feeding means for feeding out the sheets from said second sheet supporting member to the image forming apparatus; and guide means for guiding said first and second sheet supporting members so that said sheet supporting members can be drawn out independently from a sheet feeding position in a direction substantially orthogonal to the lateral arrangement of said first and second sheet supporting members, wherein said first and second feeding means are disposed so that they feed out the sheets from said first or second sheet supporting members in the same direction

16. An image forming system, comprising:

image forming means for forming an image on a sheet;

a plurality of sheet supporting means arranged laterally side by side below said image forming means for supporting respective sheets therein;

sheet feeding means for feeding out the respective sheets from each of said plural sheet supporting means; and guide means for guiding said plural sheet supporting means so that said plural sheet supporting means can be drawn out independently in a direction substantially orthogonal to a direction said plural sheet supporting means are arranged upon supplementing the sheets to said sheet supporting means; and conveying means for conveying the sheet fed from said sheet feeding means to said image forming means, wherein said sheet feeding means comprises a feed rotary member rotated in the sheet feeding direction, and a friction separating member for separating the sheets one by one between said friction separating member and said feed rotary member, said feed rotary member and said friction separating member being supported by discrete support members, said support members arranged with a predetermined gap therebetween.

17. An image forming system comprising:

image forming means for forming an image on a sheet;

a first sheet supporting means arranged below the image forming means for supporting sheets therein;

a second sheet supporting means arranged below the image forming means side by side relative to said first sheet supporting means for supporting sheets therein;

a sheet feeding means provided in correspondence to said first and second sheet supporting means for feeding out the sheets from said first and second sheet supporting means;

guide means for guiding said first and second sheet supporting means so that they can be drawn out independently in a direction substantially orthogonal to a direction said first sheet supporting means and said second sheet supporting means are arranged;

a first path for introducing the sheet fed from said first sheet supporting means to said image forming means; and a second path disposed above said first sheet supporting means for introducing the sheet fed from said second sheet supporting means to said image forming means, wherein said second path can be drawn out in the same direction as a drawing direction of said first sheet supporting means.

18. An automatic sheet feeding apparatus connected to an image forming apparatus forming an image on a sheet, comprising:

a first sheet supporting member for supporting sheets therein;

a second sheet supporting member for supporting sheets therein;

a first sheet feeding means for feeding out the sheet from said first sheet supporting member;

a second sheet feeding means for feeding out the sheet from said second sheet supporting member, said second sheet feeding means comprising a feed rotary member rotated in a sheet feeding direction, and a friction separating member urged against said feed rotary member with a predetermined separating pressure for separating the sheets one by one between said feed rotary member and said friction separating member;

release means for releasing said separating pressure between said feed rotary member and said friction separating member;

guide means for guiding said first and second sheet supporting means so that they can be drawn out independently in a direction substantially orthogonal to a direction where said first and sheet supporting member are arranged;

a first path for introducing the sheet fed from said first sheet supporting member to said image forming apparatus; and a second path disposed above said first sheet supporting member for introducing the sheet fed from said second sheet supporting member to said image forming apparatus, wherein said second path can be drawn out in the same direction as drawing direction of said first and second supporting member upon release of the separating pressure by said release means.

19. An automatic sheet feeding apparatus according to claim 18, wherein said release means releases the separating pressure in response to a drawing out of said second sheet supporting member.

20. An image forming system, comprising:

an image forming means for forming an image on a sheet;

a first sheet supporting member for supporting sheets therein;

a second sheet supporting member for supporting sheets therein;

a first sheet feeding means for feeding out the sheet from said first sheet supporting member;

a second sheet feeding means for feeding out the sheet from said second sheet supporting member, said second sheet feeding means comprising a feed rotary member rotated in a sheet feeding direction, and a friction separating member urged against feed rotary member with a predetermined separating pressure for separating the sheets one by one between said feed rotary member and said friction separating member;

release means for releasing said separating pressure between said feed rotary member and said friction separating member;

guide means for guiding said first and second sheet supporting means so that they can be drawn out independently in a direction substantially orthogonal to a direction where first sheet supporting member and said second sheet supporting member are arranged;

a first path for introducing the sheet fed from said first sheet supporting member to said image forming means; and a second path disposed above said first sheet supporting member for introducing the sheet fed from said second sheet supporting member to said image forming means, wherein said second path can be drawn out in the same direction as drawing direction of said first and second supporting member upon a release of said separating pressure by said release means.

21. An automatic sheet feeding apparatus disposed below an image forming apparatus forming an image on a sheet, comprising:

sheet supporting means having a first sheet supporting member and a second sheet supporting member arranged laterally side by side below said image forming apparatus for supporting sheets therein;

sheet feeding means for feeding out the sheets from each of said first and second sheet supporting members to the image forming apparatus;

sheet path means comprising a first path for guiding the sheet fed from said first sheet supporting member to said image forming means and a second path for guiding the sheet fed from said second sheet supporting member to said image forming apparatus over said first sheet supporting member; and guide means for guiding said first and second sheet supporting members so that they can be drawn out from the sheet feeding position independently in a direction substantially orthogonal to the lateral arrangement of said first and second sheet supporting members, wherein said guide means has a substantially equal contour as that of said image forming apparatus, and said guide means contains said first and second sheet supporting members therein when said first and second sheet supporting members are positioned in the sheet feeding position.

22. An image forming system, comprising:

image forming apparatus for forming an image on a sheet;

sheet supporting means having a first sheet supporting member and a second sheet supporting member arranged laterally side by side below said image forming apparatus for supporting sheets therein;

sheet feeding means for feeding out the sheets from each of said first and second sheet supporting members to the image forming apparatus;

sheet path means comprising a first path for guiding the sheet fed from said first sheet supporting member to said image forming means and a second path for guiding the sheet fed from said second sheet supporting member to said image forming apparatus through over said firs sheet supporting member; and guide means for guiding said first and second sheet supporting members so that they can be drawn out from the sheet feeding position independently in a direction substantially orthogonal to the lateral arrangement of said first and second sheet supporting members, wherein said guide means has contour substantially same as contour of said image forming apparatus, said guide means contains said first and second sheet supporting members therein when said first and second sheet supporting members are positioned in the sheet feeding position.

* * * * *

UNITED STATES PATENT AND TRADEMARK OFFICE

CERTIFICATE OF CORRECTION

PATENT NO. : 5,368,285
DATED : November 29, 1994
INVENTOR(S) : TOSHIHIKO KUSUMOTO It is certified that error appears in the above-indentified patent and that said Letters Patent is hereby corrected as shown below:

Column 8,
line 18, "forming image" should read --forming apparatus forming an image--.

Column 10,
line 67, "first and sheet" should read --first and second sheet--.

Column 11,
line 9, "drawing" should read --a drawing--;
line 32, "feed" should read --said feed--;
line 44, "first" should read --said first--; and
line 55, "drawing" should read --a drawing--.

Column 12,
line 44, "through" should be deleted; and "firs" should read --first--;
line 52, "contour" should read --a contour--; and
line 53, "same as contour" should read --the same as a contour--.

Signed and Sealed this

Twelfth Day of September, 1995

Bruce Lehman

*Attest:*

BRUCE LEHMAN

*Attesting Officer*

*Commissioner of Patents and Trademarks*